US010934064B2

(12) United States Patent
De Wilde et al.

(10) Patent No.: US 10,934,064 B2
(45) Date of Patent: Mar. 2, 2021

(54) CONSUMER PRODUCT THAT INCLUDES A CONTAINER AND UNIT DOSE ARTICLES

(71) Applicant: The Procter & Gamble Company, Cincinnati, OH (US)

(72) Inventors: Vincent Hubert Monique De Wilde, Brussels (BE); Marion Michele Marie-Pierre Dubreuil Rambaud, Waterloo (BE); Clara Sophie Lea Ng Pak Leung, Brussels (BE); Simone Pallotto, Brussels (BE); Thierry Christian Francis Dagnelie, Waterloo (BE); Massimiliano Carlomagno, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 32 days.

(21) Appl. No.: 16/181,605

(22) Filed: Nov. 6, 2018

(65) Prior Publication Data

US 2019/0135503 A1 May 9, 2019

(30) Foreign Application Priority Data

Nov. 8, 2017 (EP) ..... 17200691
Nov. 8, 2017 (EP) ..... 17200692
(Continued)

(51) Int. Cl.
*B65D 43/22* (2006.01)
*B65D 43/16* (2006.01)
*B65D 50/04* (2006.01)

(52) U.S. Cl.
CPC ..... *B65D 43/22* (2013.01); *B65D 43/162* (2013.01); *B65D 43/169* (2013.01);
(Continued)

(58) Field of Classification Search
CPC ..... B65D 43/22; B65D 43/163; B65D 43/16; B65D 43/14; B65D 43/169; B65D 43/162;
(Continued)

(56) References Cited

U.S. PATENT DOCUMENTS 3,825,110 A 7/1974 Halbich
6,269,970 B1 * 8/2001 Huang ..... B65D 43/164 220/836
(Continued)

FOREIGN PATENT DOCUMENTS

JP 2016132455 A1 7/2016

OTHER PUBLICATIONS

EP Search Report for application No. 17200692.6-1017, dated Mar. 29, 2018, 8 pages.

*Primary Examiner* — Robert J Hicks
(74) *Attorney, Agent, or Firm* — Gregory S. Darley-Emerson

(57) ABSTRACT

A consumer product that includes a container and at least one water-soluble unit dose article, the container including a lid able to move from an open to closed position via at least one hinge, where the container includes at least one locking device with a lid component and a wall component, where the wall component includes a support member and a hook member. The water-soluble unit dose articles may include a water-soluble film and a detergent composition.

17 Claims, 11 Drawing Sheets

(30) Foreign Application Priority Data

Oct. 15, 2018 (EP) ..... 18200495
Oct. 15, 2018 (EP) ..... 18200509

(52) U.S. Cl.
CPC ..... *B65D 50/046* (2013.01); *B65D 2215/02* (2013.01); *B65D 2251/1025* (2013.01); *B65D 2543/00194* (2013.01)

(58) Field of Classification Search
CPC .... B65D 43/164; B65D 45/16; B65D 50/046; B65D 50/045; B65D 50/04
USPC ..... 220/324, 315, 836, 810, 833, 4.24, 4.23, 220/4.22, 4.21
See application file for complete search history.

(56) References Cited

U.S. PATENT DOCUMENTS

| | | | | |
|---|---|---|---|---|
| 6,772,904 | B1 * | 8/2004 | Gilliam ..... | B65D 1/10 220/254.3 |
| 2015/0315532 | A1 | 11/2015 | Bergbohm et al. | |
| 2016/0023816 | A1 | 1/2016 | Giraud et al. | |
| 2017/0203889 | A1 | 7/2017 | Butter-Jentsch et al. | |
| 2017/0334615 | A1 | 11/2017 | Golta et al. | |

* cited by examiner

CONSUMER PRODUCT THAT INCLUDES A CONTAINER AND UNIT DOSE ARTICLES

FIELD OF THE INVENTION

The present disclosure relates to a packaging for water-soluble unit dose articles, packages that include water-soluble unit dose articles, and methods of dosing detergent compositions.

BACKGROUND OF THE INVENTION

Water-soluble unit dose articles are liked by consumers as they are convenient and efficient to use in wash operations. Such articles comprise a water-soluble film which defines at least one internal compartment wherein the compartment houses a detergent composition.

Water-soluble unit dose articles are often sold to consumers in containers with lids. Closure of the lids aims to minimise moisture ingress into the containers which can affect the physical stability of the internal water-soluble unit dose articles. Such ingress is particularly problematic in high humidity environments such as those found in the vicinity of the wash operation (such as laundry or dish washing). Closure of lids also aims to reduce spillage or removal of the articles from the container when it is not intended or otherwise desirable, for example, if the container were to fall or become upside down or fall on its side. Therefore, such containers are manufactured with locking means to ensure the lid remains closed when not in use.

In addition, when the lid of the container is closed, the locking means serve to hinder the ability of children (of less than 5 years), to gain access to the contents of the container and subsequently become exposed to the water-soluble unit dose articles.

Traditionally such containers were manufactured such that the locking means was located on the front outer surface of the container. These types of locking means comprised a part on the lid and a part on the container wall and were disengaged by the user pushing or pulling the lid component towards or away from them releasing it from the wall component. However, one potential issue with the location of such locking means was that there may be a tendency for them to be damaged during transport, particularly if the packages are not packed for transport in such a way as to specifically reduce damage. This damage was caused by adjacent containers hitting into one another or rubbing against one another causing the locking means on the outer surface of the tub to be damaged.

In an attempt to overcome these issues, manufacturers have relocated the wall component of the lock to the top of the container wall, with a corresponding lid component remaining in the lid. This relocation of the locking means remained intuitive for adults in terms of how to operate it, yet reduced the number of instances of damage during manufacture, shipping and storage. In addition, relocating the locking means in such a way made it even more difficult for children to locate the locking means on the container.

However, it was found that such locking means can be difficult for consumers to disengage as they required the wall component to be pushed away from the user whilst simultaneously lifting the lid. This might result in the container simply being pushed away from the consumer rather than the lock disengaging and/or the consumer found the whole operation awkward or uncomfortable to the fingers and hand.

US20150315532 discloses a container with a lid that can be opened in a user-friendly manner. The container has two closing means wherein the first closing means can be opened by direct application of force to the respective frame section and the second closing means can be opened by application of direct force to the respective lid section.

Therefore, there remains a need in the art for a container comprising water-soluble unit dose articles wherein the container comprises a locking means that effectively keeps the lid closed when not in use and does not suffer from damage associated with the locking means being attached to the front of the container whilst remaining comfortable and intuitive for the consumer to operate. In addition, the container should hinder the ability of children to gain access to the contents of the container when the lid is closed.

It was surprisingly found that the container according to the present invention overcame these problems. Without wishing to be bound by theory, the locking means of the present container requires the user to operate a 'pinching motion' to disengage the locking means. Such a motion is more comfortable and intuitive for the human hand and also allows for the consumer to simultaneously lift the lid. The locking means also effectively keeps the lid closed when not in use.

Furthermore, manufacturing efficiency of containers comprising water-soluble unit dose articles can be improved as the number of instances of the closing means being damaged during manufacture is reduced.

SUMMARY OF THE INVENTION

The present disclosure relates to a consumer product (1) that includes a container (2) and at least one water-soluble unit dose article (3) contained therein; where the container (2) includes a base (4), an opening (5) positioned opposite to the base (4), and at least one wall (6) extending vertically from the base (4) to the opening, where the at least one wall (6) terminates in an upper edge (7) of the at least one wall (6), and where said wall (6) includes an inner surface (8) and an outer surface (9); and where the base (4) and the at least one wall (6) define an internal compartment (10) where the internal compartment is accessible from the opening; a lid (11) able to move from an open to closed position via at least one hinge (12) and where when in the closed position covers the opening (5); where the container (2) includes at least one locking means, where the locking means includes a lid component (14) and a wall component (15), where the wall component (15) includes a support member (16) extending from the upper edge (7) of the at least one wall (6) or the inner surface (8) of the at least one wall (6), and a hook member (17); and where, when the lid (11) is in a closed position, the hook member (17) engages the lid component (14) such that only application of force to the hook member (17) will disengage the wall component (15) from the lid component (14); and where the hook member (17) extends from the support member (16) towards the interior of the container such that to disengage the wall component (15) from the lid component (14) requires application of force to the hook member (17) wherein the application of force is in the direction towards the inner surface (8).

DETAILED DESCRIPTION OF THE INVENTION

Consumer Product

Figure 1:
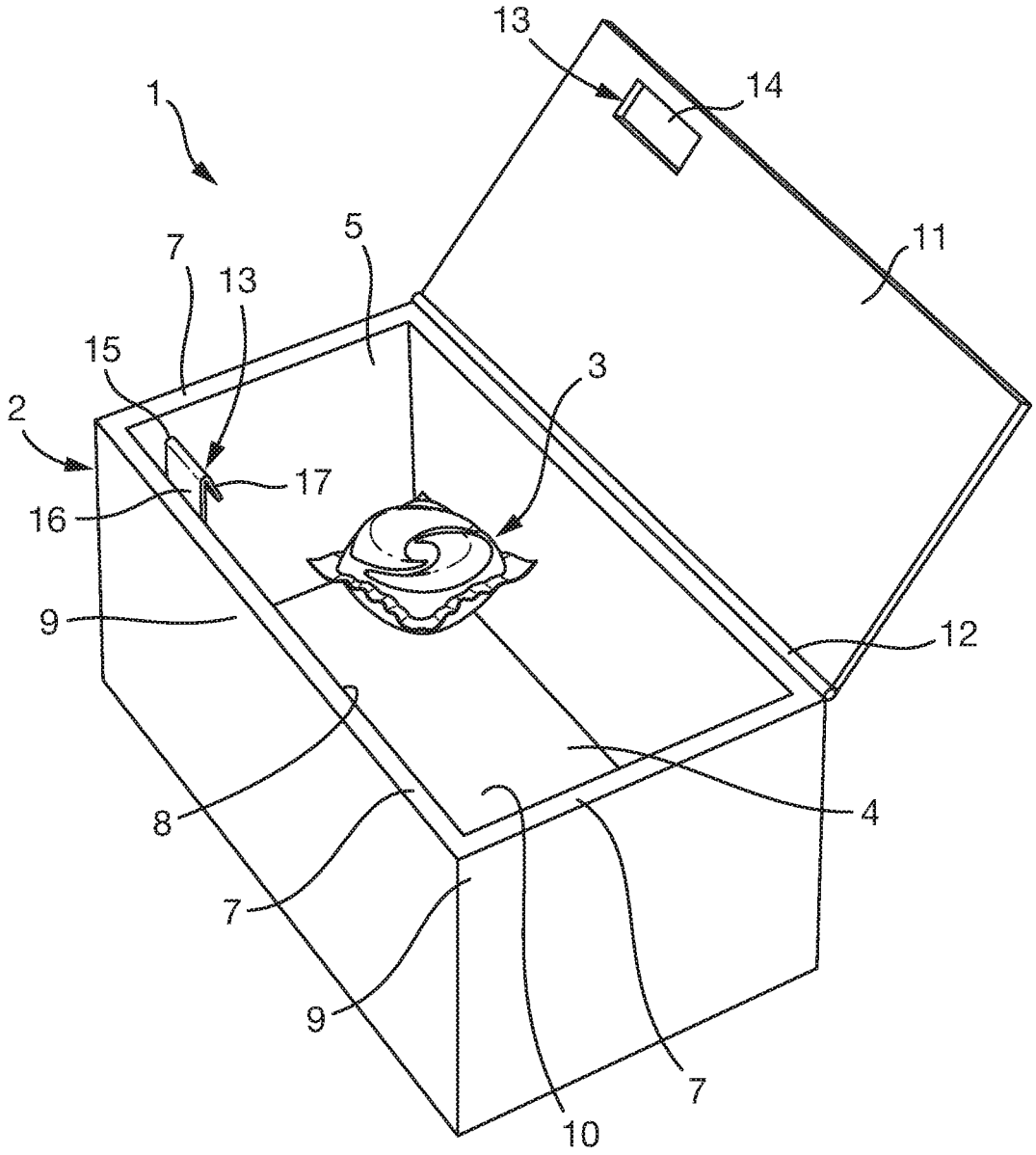
FIG. 1. discloses a consumer product according to the present invention comprising a container and at least one water-soluble unit dose article contained therein.

The present disclosure relates to a consumer product comprising a container and at least one water-soluble unit dose article.

The at least one water-soluble unit dose article is contained within the container. The container and the water-soluble unit dose article are described in more detail below.

The consumer product can be sold 'as is', in other words the consumer product is the item that the consumer picks up from the shelf. Alternatively, the consumer product could be housed as one unit of a multi-component product. For example, more than one consumer product could be housed within an outer package and the multiple packaged consumer products sold together in a single purchase.

The consumer product may comprise aesthetic elements, for example shrink sleeves or labels attached to the container. Alternatively, the container may be coloured or printed with aesthetic elements or informative print such as usage instructions.

Container

The consumer product comprises a container. The container needs to be capable of containing the at least one water-soluble unit dose article. The container may have any suitable size dependent upon the number of water-soluble unit dose articles contained within the container.

The container may be of any suitable shape. The container may have an overall straight shape, e.g. with straight sides, or may have a curved shape or may comprise both straight and curved elements. The container may comprise flat surfaces as well as surfaces comprising embossments or other structural element, e.g. designed to improve gripping or structural integrity.

Preferably the container has a rectangular shape when viewed from the top of the bottom. When viewed from the bottom, the rectangular shape has a length to width ratio between 1.5:1 and 2.5:1.

The container may have a measured length of between 100 mm and 300 mm, preferably between 140 mm and 260 mm. The container may have a measured width between 60 mm and 140 mm, preferably between 65 mm and 115 mm.

The container may have any suitable shape. Those skilled in the art will be aware of suitable shapes. The container may have a cubic shape, a cylindrical shape, a rectangular shape or a mixture thereof. Whilst the container may have an overall linear shape, for example rectangular, it may comprise curved walls. For example, when viewed from above the container may have rectangular shape, however, when viewed from the front it may comprise convex curved walls curving from the top of the container to the bottom of the container.

The container may be made from any suitable material. The container may be made of natural materials, synthetic materials or a mixture thereof, preferably synthetic materials, more preferably plastic.

The container may be made from plastic materials, metallic materials, paper materials, or a mixture thereof. The container may be made from materials comprising recycled materials.

The container may be made from a plastic material, preferably a polyolefin material. The container may be made from polypropylene, polystyrene, polyethylene, high-density polyethylene, polyethylene terephthalate, polyvinyl chloride, Acrylonitrile Butadiene Styrene, Polycarbonates, Polyamides or a mixture thereof. Preferably, the container may be made from polypropylene, polystyrene, high-density polyethylene, polyethylene terephthalate, or a mixture thereof.

The plastic material may have a tensile modulus ranging from 1250 MPa to 3000 MPa, preferably between 1300 MPa and 2300 MPa. Those skilled in the art will know how to measure tensile modulus using techniques commonly known in the art.

The container may be made from metallic materials wherein the metallic material is preferably selected from aluminium, steel or a mixture thereof.

The container may be made from paper materials wherein the paper material is preferably selected from carboard, laminates, cellulose pulp materials or a mixture thereof.

The material used to make the container may comprise other ingredients, such as colorants, preservatives, plasticisers, UV stabilizers, Oxygen, perfume, recycled materials and moisture barriers or a mixture thereof. The container may comprise areas of external or internal printing.

The container may be made using any suitable process.

Suitable processes include but are not limited to thermoforming, injection molding, injection stretch blow molding, extrusion blowmolding, or a mixture thereof preferably thermoforming or injection molding or a mixture thereof.

Suitable processes include, but or not limited to, tube forming from a flat laminate with a welding step, extruded tube forming, folding or a mixture thereof.

The container may be opaque translucent, or a mixture thereof. Preferably, the container is opaque.

The container comprises a base. When at rest the base is located on the underside of the container as it rests on a surface. The base may be substantial flat, that is to say not comprising areas that are substantially raised versus other areas. Alternatively, the base may comprise a raised area. This has the benefit of creating a reservoir within the container which can catch any leaked detergent composition from ruptured unit dose articles. This has the advantage of minimizing unwanted contact between unruptured unit dose articles and the leaked composition.

The container comprises an opening positioned opposite to the base. At least one wall extends vertically from said base to said opening. By vertically in this context we herein mean approximately vertical. In other words, the wall does not to extend from the base at an angle of exactly 90° rather there can be variation either side of exactly 90°. Those skilled in the art will understand what relevant variation there can be. The wall may extend from the base at an angle between 75° and 105°, preferably between 80° and 100°, more preferably between 85° and 95° relative to the base. Preferably the container comprises at least 2 walls, preferably at least 3 walls, most preferably at least 4 walls extending between said base and said opening. Preferably the container comprises 4 walls so that the container has an overall square or rectangular shape.

The at least one wall terminates in an upper edge of said at least one wall. The upper edge should be understood to be top of the at least wall. The upper edge is preferably horizontal such that it is parallel to the base. However, the upper edge does not have to be completely horizontal, for example it can have elevated areas or run with a substantially diagonal direction.

The width of the upper surface may correspond to the thickness of the at least one wall. However, the upper surface may be thinner or thicker than the at least one wall. The upper surface may comprise different thickness within the same container. The thickness of the upper surface of one wall may differ to the thickness of the upper surface of another wall on the same container.

The thickness of the upper surface may be between 1 mm and 8 mm, preferably between 2 mm and 6 mm.

Indeed, the at least one wall may comprise at least two sections. The two sections may differ in height, thickness or both. The width of the upper edge may correspond to the thickness of one section of the at least one wall.

The at least two sections are joined together, via mechanical connection, via adhesive or a combination thereof. Mechanical connections may comprise simple hooks on one or both of the sections. Preferably, the at least two sections are joined together via use of both mechanical connections and adhesive. By adhesive we mean hot melt adhesive, reactive hot melt adhesive, thermosetting adhesive, pressure sensitive adhesive, contact glue adhesive. Preferably, the adhesive is a hot melt pressure sensitive adhesive. Preferably, the hot melt pressure sensitive adhesive is suitable to tackify and bond to a range of materials including one or more materials mentioned above. Preferably, the at least one wall comprises a lower section and an upper section. The lower section rises up from the base. The upper section is then joined to the lower section preferably via adhesive and comprises the upper edge. Alternatively, the at least two sections may be arranged vertically such that both sections raise up adjacent to one another from the base.

The at least one wall may be made from rigid material, a flexible material or a mixture thereof. The base may be made from a rigid material, a flexible material or a mixture thereof. The at least one wall may comprise an upper section and a lower section wherein the upper section is made of rigid material and the lower section is made from flexible material, and preferably wherein the base is made from flexible material.

The at least one wall comprises an inner surface and an outer surface. The outer surface is in contact with the exterior environment to the container, whereas the inner wall is in contact with the interior environment of the container.

The base and the at least one wall define an internal compartment. The inner surface of the at least one wall is in contact with the environment of the internal compartment.

The internal compartment is accessible from the opening. The container may comprise more than one internal compartment. The container may comprise at least one compartment, or at least two compartments or at least three compartments.

The container also comprises a lid. The lid is able to move from an open to closed position via a hinge. When in the closed position, the lid covers the opening. By 'cover the opening' we herein mean preferably, at least 90%, more preferably at least 95%, even more preferably at least 98% of the area of the opening is covered by the lid. It should be understood that due to manufacturing tolerances etc, there may still be a gap between the upper edge and the lid when closed, but the intention is that any gap present is not large enough to allow access to the opening by the user or allow the at least one water-soluble unit dose article to be removed purposively or accidentally from the internal compartment.

At least part of the opening may comprise a permanent cover, and the lid covers the remaining area of the opening.

If the lid is assumed to be at an angle of 0° when closed, then the lid can open to a maximum angle relative to that when closed of between greater than 0° and 270°, preferably between 60° and 180°, more preferably between 90° and 150°.

The container comprises at least one locking means. Preferably, the container comprises at least two locking means. Preferably, the at least two locking means are spaced apart by a distance of from 50 mm to 180 mm. The at least two locking means might be present on the same wall or on different walls, preferably on the same wall. Preferably the container comprises two locking means, as such fitting the number of consumer hands and enabling the consumer to open the container in a coordinated motion.

The locking means comprises a lid component and a wall component. In other words, a component of the locking means is located on or within the lid and a separate component of the locking means is located on the inner surface of the at least one wall or on the upper edge. The interaction of the lid component and the wall component results in the locking means being engaged and the lid being secured in a locked position.

The lid component is preferably simply a recess or hole in the lid able to accommodate the hook member. The recess or hole can be of any suitable shape, providing it can receive the hook member and allows for engagement of the hook member to lock the lid in place and disengagement of the hook member via an appropriate action to disengage it.

The wall component comprises a support member and a hook member. The support member extends from the upper edge of the at least one wall or the inner surface of the at least one wall. The hook member is attached to the support member. The support member and hook member may be two separate pieces joined together. Alternatively, the support member and hook member can be formed from one integral part.

Preferably, the support member and the hooking member are arranged such that the wall component is in the shape of an inverted U. Preferably, the U shape is attached to the inner wall or the upper edge via a horizontal connecting member, or substantially horizontal connecting member extending from the inner wall or the upper edge to the support member. By substantially horizontal we herein mean the connecting member is not perfectly horizontal but may be at a slight angle. Those skilled in the art will understand what relevant variation there can be. The connecting member may extend from the inner wall at an angle between 75° and 105°, preferably between 80° and 100°, more preferably between 85° and 95° relative to the inner wall. Despite the angle the connecting member will still achieve the same benefit as a perfectly horizontal connecting member.

When the lid is in a closed position, the hook member engages the lid component such that application of force to the hook member is needed to disengage the wall component from the lid component. Preferably, a counterforce is needed by the user to disengage the wall component from the lid component. Such counterforce is preferably as a result of the finger/thumb pinch motion in which the finger or thumb is placed on the hook member and the other digit is placed on the outer surface of the wall or side of the lid. The user then pinches the thumb and finger together disengaging the wall component from the lid component using the side of the lid or outer surface of the wall as the surface for effecting the counterforce.

The hook member extends from the support member towards the interior of the container such that to disengage the wall component from the lid component requires application of force to the hook member. The application of force to the hook member is in the direction towards the inner wall. In other words, application of force pushes the hook member towards the support member which extends from the inner wall.

Preferably, the support member extends from the inner surface of the at least one wall and the wall component is positioned such that it does not extend higher than the upper edge of the at least one wall. In other words, the wall member does not protrude above the height of the at least one wall.

Preferably, upon engagement of the wall component with the lid component, the support member and hook member are arranged such that the hook member resists rotational movement, whilst still allowing the wall component as a whole to move in response to the force exerted by the engagement of the wall component with the lid component. In other words, during engagement, the wall component may be displaced, but returns to its original position upon engagement of the lid component with the wall component. During this displacement, preferably, the hook member itself is not displaced versus the support member.

Alternatively, upon engagement of the wall component with the lid component, the support member and hook member are arranged such that the support member resists any movement, whilst still allowing the hook member to move in response to the force exerted by the engagement of the wall component with the lid component. In other words, during engagement, the hook member may be displaced, but returns to its original position upon engagement of the lid component with the wall component.

Preferably, the hook member engages the lid component in two axes. This will be demonstrated in the examples.

Preferably, the unlocking of the hook member from the lid component does not deform the lid or the at least one wall. By deformation we herein mean permanent or temporary deformation of the shape of the wall or lid is not necessary in order to unlock the hook member from the lid component. Some minor temporary deformation of the shape of the wall or lid may be experienced due to the force of the user opening the locking means, but such minor deformation is not necessary to the operation of the locking means.

Preferably, the outer surface of the at least one wall is devoid of any locking means. By this we mean that preferably no component of a locking means is present on the outer surface of the at least one wall. In this instance, the locking means can mean the locking means as described above or any other locking means.

Preferably, the container has a footprint defined as the largest horizontal cross-sectional area through the container and the at least one locking means does not extend beyond the footprint of the container. In other words, the at least one locking means preferably does not extend any further into the external environment than the outer surface of the at least one wall.

Preferably, the lid comprises a recess surrounded by an outer ridge. Preferably, the lid component is comprised within the outer ridge. The outer ridge may comprise an inner side, an outer side and a top and wherein the lid component is comprised within the inner side, the top, or a mixture thereof. Preferably, the lid component is a hole through the lid.

Preferably, the lid has a footprint defined as the largest horizontal cross-sectional area of the lid when in a closed position and the container has a footprint defined as the horizontal cross-sectional area through the container and wherein the footprint of the lid is greater than the footprint of the container. In other words, the area of the lid is preferably greater than that of the area of the opening of the lid and the upper edge. This means that when the lid is in the closed position it preferably completely covers the opening of the container and extends over the upper edge of the at least one wall. Preferably, a lip extends from the outer surface of the at least one wall such that the footprint of the lip is the same as, or greater than the footprint of the lid. If the lip extends to a point greater than the footprint of the lid, then the lip may have an 'L' or 'J' shape. The lip may be interrupted in the area aligned with the locking means. In other words, the lip may be discontinuous and comprise a gap corresponding to the location of the locking means being present on the upper edge or inner wall of the at least one wall. Without wishing to be bound by theory, this gap may also serve as the counterforce point for the finger/thumb pinch motion. The lid may comprise an element to act as a counterforce surface for the finger or thumb of the consumer.

The lid is able to move from an open to a closed position and vice versa via a hinge. Preferably, the lid is attached to the container via at least one hinge. More preferably, the container comprises a first wall and a second wall, wherein the hinge is connected to the second wall, and wherein the first wall is positioned opposite the second wall, and wherein the first wall comprises the at least one locking means, preferably at least two locking means.

The hinge can be any suitable hinge. Those skilled in the art will be aware of suitable hinges. The hinge may be a living hinge or an assembled hinge, or a mixture thereof. A living hinge is understood to be an integrated component made of the same material as the lid and the container. It is essentially a thin flexible area of material allowing movement between the lid and container.

Preferably the hinge is a living hinge. The living hinge may be a bi-stable hinge or a butterfly hinge or a mixture thereof.

The container may comprise a biasing system that biases the lid towards the open position. The biasing system may comprise an elastic member. More preferably, a projection located on the closure system, preferably on the lid, elastically deforms the elastic member when the lid is in the closed position.

The lid may comprise debossed or embossed regions to indicate to the consumer the location of the locking means when the lid is closed and/or direction in which force needs to be applied to release the locking means.

Method of Assembly

The consumer product may be assembled using any suitable technique. Those skilled in the art will be aware of suitable techniques. The consumer product may be assembled using an automated system, a manual system or a mixture thereof.

The consumer product may be assembled by forming the container, then adding the water-soluble unit dose articles and then closing the lid. Filling of the container may be done via a suitable automated process or manually.

The consumer product may be assembled by forming the base and lower wall sections. The water-soluble unit dose articles are then added. Upper wall sections comprising the lid and manufactured separately are then added to the upper wall sections and base containing the water-soluble unit dose articles. Filling of the container may be done via a suitable automated process or manually.

Water-Soluble Unit Dose Article

The consumer product comprises at least one water-soluble unit dose article, preferably at least two water-soluble unit dose articles.

A water-soluble unit dose article is generally in the form of a pouch. It comprises a unitary dose of a composition as a volume sufficient to provide a benefit in an end application.

The water-soluble unit dose article comprises at least one water-soluble film shaped such that the unit-dose article comprises at least one internal compartment surrounded by the water-soluble film. The at least one compartment comprises a cleaning composition. The water-soluble film is sealed such that the cleaning composition does not leak out of the compartment during storage. However, upon addition of the water-soluble unit dose article to water, the water-soluble film dissolves and releases the contents of the internal compartment into the wash liquor.

The film is described in more detail below.

The unit dose article may comprise more than one compartment, even at least two compartments, or even at least three compartments, or even at least four compartments, or even at least five compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

The cleaning composition may be a laundry detergent composition, an automatic dishwashing composition, a hard surface cleaning composition or a combination thereof. The cleaning composition may comprise a solid, a liquid or a mixture thereof. The term liquid includes a gel, a solution, a dispersion, a paste or a mixture thereof.

The unit dose article has a height, a width and a length. The maximum of any of these dimensions is meant to mean the greatest distance between two points on opposite sides of the unit dose article. In other words, the unit dose article may not have straight sides and so may have variable lengths, widths and heights depending on where the measurement is taken. Therefore, the maximum should be measured at any two points that are the furthest apart from each other.

The maximum length may be between 2 cm and 5 cm, or even between 2 cm and 4 cm, or even between 2 cm and 3 cm. The maximum length maybe greater than 2 cm and less than 6 cm.

The maximum width may be between 2 cm and 5 cm. The maximum width maybe greater than 3 cm and less than 6 cm.

The maximum height may be between 2 cm and 5 cm. The maximum height maybe greater than 2 cm and less than 4 cm.

These lengths may be in the presence or absence of the flange.

Preferably, the length: height ratio is from 3:1 to 1:1; or the width: height ratio is from 3:1 to 1:1, or even 2.5:1 to 1:1; or the ratio of length to height is from 3:1 to 1:1 and the ratio of width to height is from 3:1 to 1:1, or even 2.5:1 to 1:1, or a combination thereof. These ratios may be in the presence of absence of a flange.

Each individual unit dose article may have a weight of between 10 g and 40 g, or even between 15 g and 35 g.

The film of the present invention is soluble or dispersible in water. Prior to be being formed into a unit dose article, the water-soluble film preferably has a thickness of from 20 to 150 micron, preferably 35 to 125 micron, even more preferably 50 to 110 micron, most preferably about 76 micron.

Preferred film materials are preferably polymeric materials. The film material can, for example, be obtained by casting, blow-moulding, extrusion or blown extrusion of the polymeric material, as known in the art.

Preferably, the water-soluble film comprises polyvinyl alcohol polymer or copolymer, preferably a blend of polyvinylalcohol polymers and/or polyvinylalcohol copolymers, preferably selected from sulphonated and carboxylated anionic polyvinylalcohol copolymers especially carboxylated anionic polyvinylalcohol copolymers, most preferably a blend of a polyvinylalcohol homopolymer and a carboxylated anionic polyvinylalcohol copolymer.

Preferred films are those supplied by Monosol under the trade references M8630, M8900, M8779, M8310.

The film may be opaque, transparent or translucent. The film may comprise a printed area. The area of print may be achieved using standard techniques, such as flexographic printing or inkjet printing.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

The water-soluble unit dose article comprises a detergent composition. The detergent composition can be any suitable detergent composition. The detergent composition may be selected from laundry detergent composition, dish washing detergent composition, hard surface cleaning detergent composition or a mixture thereof, preferably a laundry detergent composition. The detergent composition may be in any suitable form. The detergent composition may be a solid, a liquid or a mixture thereof.

Those skilled in the art will know how to formulate and make a suitable detergent composition using known knowledge and techniques. The detergent composition may comprise common detergent ingredients including surfactants, polymers, bleach, enzymes, perfumes, dyes, structing agents, fillers, water or a mixture thereof.

Method of Dosing a Detergent

The present disclosure also relates to a method of dosing a detergent composition according to the following paragraphs;

A. A method of dosing a detergent composition comprising the steps of;
   a. Obtaining a consumer product (1) comprising a container (2) and a detergent composition, wherein the container (2) comprises;
   i. a lid (11) and at least one wall (6), wherein the at least one wall (6) comprises an inner surface (8) and an outer surface (9) and at least one locking means (13), wherein to open the lid (11) the locking means (13) needs to be manually disengaged by the user using a pinching motion (400, 401), wherein the locking means (13) comprises a latch component (15) and a lid component (14) and the pinching motion (400, 401) moves the latch component (15) from a first position to a second position, wherein the second position is closer to the outer surface (9) than the first position;
   ii. an internal compartment (10) which is accessed by disengaging the locking means (13) and opening the lid (11);
   wherein the detergent is housed in the internal compartment (10);
   b manually disengaging the locking means (13) using a pinching motion (400,401);
   c. opening the lid (11) to gain access to the internal compartment (10);
   d. removing a portion or all of the detergent composition;
   e. adding the detergent composition from step d to an automated washing apparatus, a manual washing operation or a mixture thereof;
   f. closing the lid (11) and applying sufficient force to the lid (11) to ensure the locking means (13) reengages.

B. The method according to paragraph A, wherein the user uses a thumb and a finger to perform the pinching motion (400, 401) to disengage the locking means (13).

C. The method according to any preceding paragraph wherein the container (2) comprises a wall (6) and the locking means comprises a first part on the lid (14) and a second part on the container wall (15).

D. The method according to any preceding paragraph, wherein the detergent composition in step e is added by hand, using a scoop or a mixture thereof.

E. The method according to any preceding paragraph wherein the detergent is a solid, a liquid or a mixture thereof.

F. The method according to any preceding paragraph wherein the detergent is in the form of a water-soluble unit dose article wherein the water-soluble unit dose article comprises a water-soluble film and a liquid detergent, a solid detergent or a mixture thereof.

G. The method according to any preceding paragraph wherein the lid (11) is attached to the container (2) via a hinge (12) and in step c the lid (11) is pivoted via the hinge (12) away from the rest of the container (2).

H. The method according to any preceding paragraph wherein in step f the re-engagement of the locking means (13) is accompanied by an audible indicator.

I. The method according to claim 1 wherein the time taken between steps e and f is less than about 3 minutes, J. The method according to any preceding paragraph wherein the time taken between steps e and f is less than about 2 minutes, more preferably less than about 1 minute, most preferably less than about 30 seconds.

K. The method according to any preceding paragraph wherein in step e, the detergent is added to an automatic washing machine and the wash operation performed by the automatic washing machine is initiated after step f or after step e.

L. The method according to any preceding paragraph wherein after step f the container (2) is stored at a height of greater than about 100 cm from the floor, preferably at a height of greater than about 150 cm from the floor M. The method according to any preceding paragraph wherein the container (2) comprises at least two locking means (13).

N. The method according to any preceding paragraph wherein the latch component (15) is attached to the inner surface (8) of the at least one wall (6).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

EXAMPLES

Example 1

A suitable consumer product is now exemplified in the following non-limiting example(s).

FIG. 1 discloses a consumer product according to the present invention. The consumer product (1) comprises a container (2) and at least one water-soluble unit dose article (3) contained therein. Said container (2) comprises a base (4), an opening positioned opposite to the base (4) and at least one wall (6) extending vertically from said base (4) to said opening. Said at least one wall (6) terminates in an upper edge (7) of said at least one wall (6), and wherein said wall (6) comprises an inner surface (8) and an outer surface (9). Said base (4) and the at least one wall (6) define an internal compartment (10) wherein the internal compartment (10) is accessible from the opening (5). The container also comprises a lid (11) able to move from an open to closed position via a hinge (12) and wherein when in the closed position covers the opening (5).

The container (2) comprises at least one locking means (13), wherein the locking means (13) comprises a lid component (14) and a wall component (15). The wall component (15) comprises a support member (16) extending from the upper edge (7) of the at least one wall (6) or the inner surface (8) of the at least one wall (6), and a hook member (17). When the lid (11) is in a closed position, the hook member (17) engages the lid component (14) such that only application of force to the hook member (17) will disengage the wall component (15) from the lid component (14). The hook member (17) extends from the support member (16) towards the interior of the container (10) such that to disengage the wall component (15) from the lid component (14) requires application of force to the hook member (17) wherein the application of force is in the direction towards the inner surface (8). The outer surface (9) of the at least one wall (6) is devoid of any locking means. The container (2) is opaque, translucent or a mixture thereof and made from polypropylene, polystyrene, high-density polyethylene, polyethylene terephthalate, or a mixture thereof.

Figure 2:
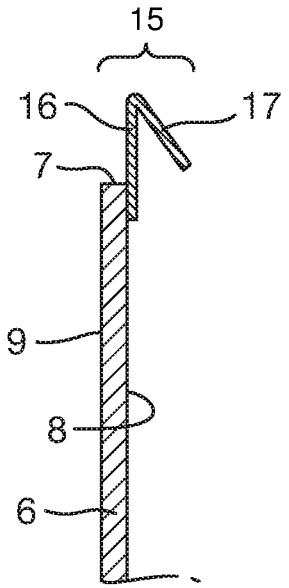
FIG. 2 discloses a cross-sectional depiction of a wall component comprising a support member attached directly to the inner surface of the at least one wall.

FIG. 2 discloses a cross-sectional depiction of wherein the wall component (15) comprises the support member (16) attached directly to the inner surface (8) of the at least one wall (6). The wall component (15) is in the shape of an inverted U.

Figure 3:
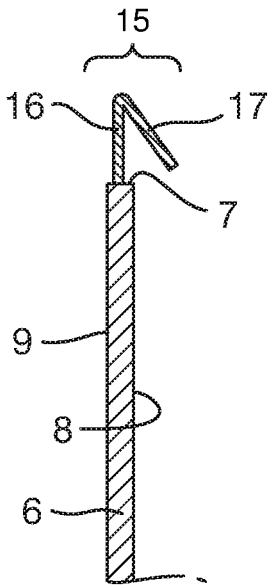
FIG. 3 discloses a cross-sectional depiction of wherein the wall component comprises the support member attached to the upper edge of the at least one wall.

FIG. 3 discloses a cross-sectional depiction of wherein the wall component (15) comprises the support member (16) attached to the upper edge (7) of the at least one wall (6). The wall component (15) is in the shape of an inverted U.

Figure 4:
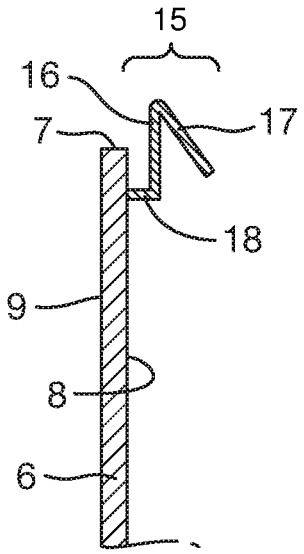
FIG. 4 discloses a cross-sectional depiction of wherein the wall component comprises the support member attached to the inner surface of the at least one wall via a horizontal connecting member.

FIG. 4 discloses a cross-sectional depiction of wherein the wall component (15) comprises the support member (16) attached to the inner surface (8) of the at least one wall via a horizontal connecting member (18). The wall component (15) is in the shape of an inverted U.

Figure 5:
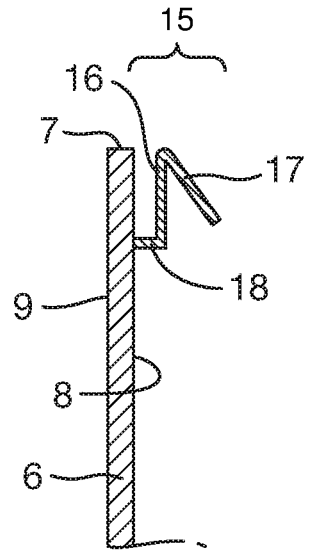
FIG. 5 discloses a cross-sectional depiction of wherein the wall component comprises the support member attached to the inner surface of the at least one wall via a horizontal connecting member.

FIG. 5 discloses a cross-sectional depiction of wherein the wall component (15) comprises the support member (16) attached to the inner surface (8) of the at least one wall via a horizontal connecting member (18). The wall component (15) is in the shape of an inverted U. The support member (16) extends from the inner surface (8) of the at least one wall (6), such that the wall component (15) is positioned so that it does not extend higher than the upper edge (7) of the at least one wall (6).

Figure 6:
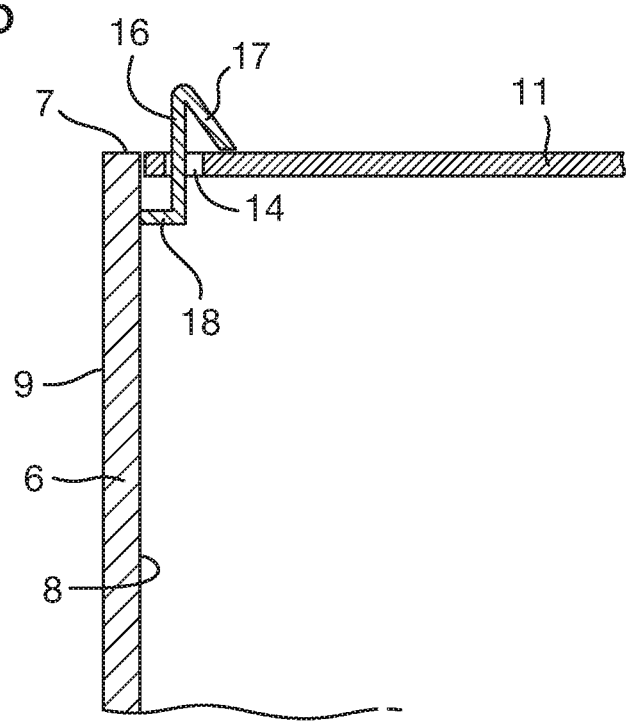
FIG. 6 discloses a cross-sectional depiction of wherein the lid is in the closed position. The wall component is engaged with the lid component and the lid is locked into position.

FIG. 6 discloses a cross-sectional depiction of wherein the lid (11) is in the closed position. The wall component (15) is engaged with the lid component (14) and the lid (11) is locked into position.

Figure 7:
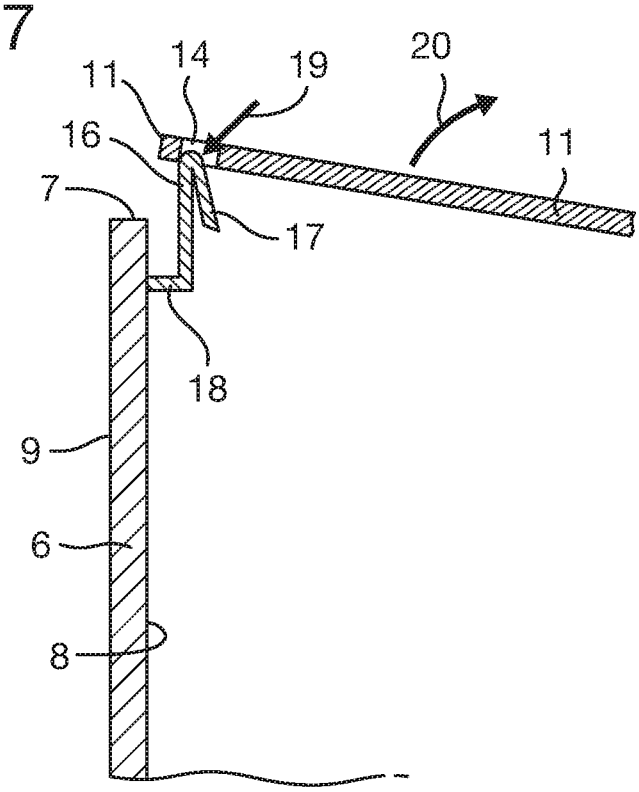
FIG. 7 discloses a cross-sectional depiction of wherein application of force to the hook member in the direction towards the inner wall, releases the lid component from the wall component allowing the lid to be radially moved away from the opening.

FIG. 7 discloses a cross-sectional depiction of wherein application of force (19) to the hook member (17) in the direction towards the inner wall (8), releases the lid component (14) from the wall component (15) allowing the lid (11) to be radially moved (20) away from the opening (5). Unlocking the hook member (17) from the lid component (14) does not deform the lid (11) or the at least one wall (6). By deformation we herein mean permanent or temporary deformation of the shape of the wall or lid is not necessary in order to unlock the hook member from the lid component. Some minor temporary deformation of the shape of the wall or lid may be experienced due to the force of the user opening the locking means, but such minor deformation is not necessary to the operation of the locking means.

Figure 8:
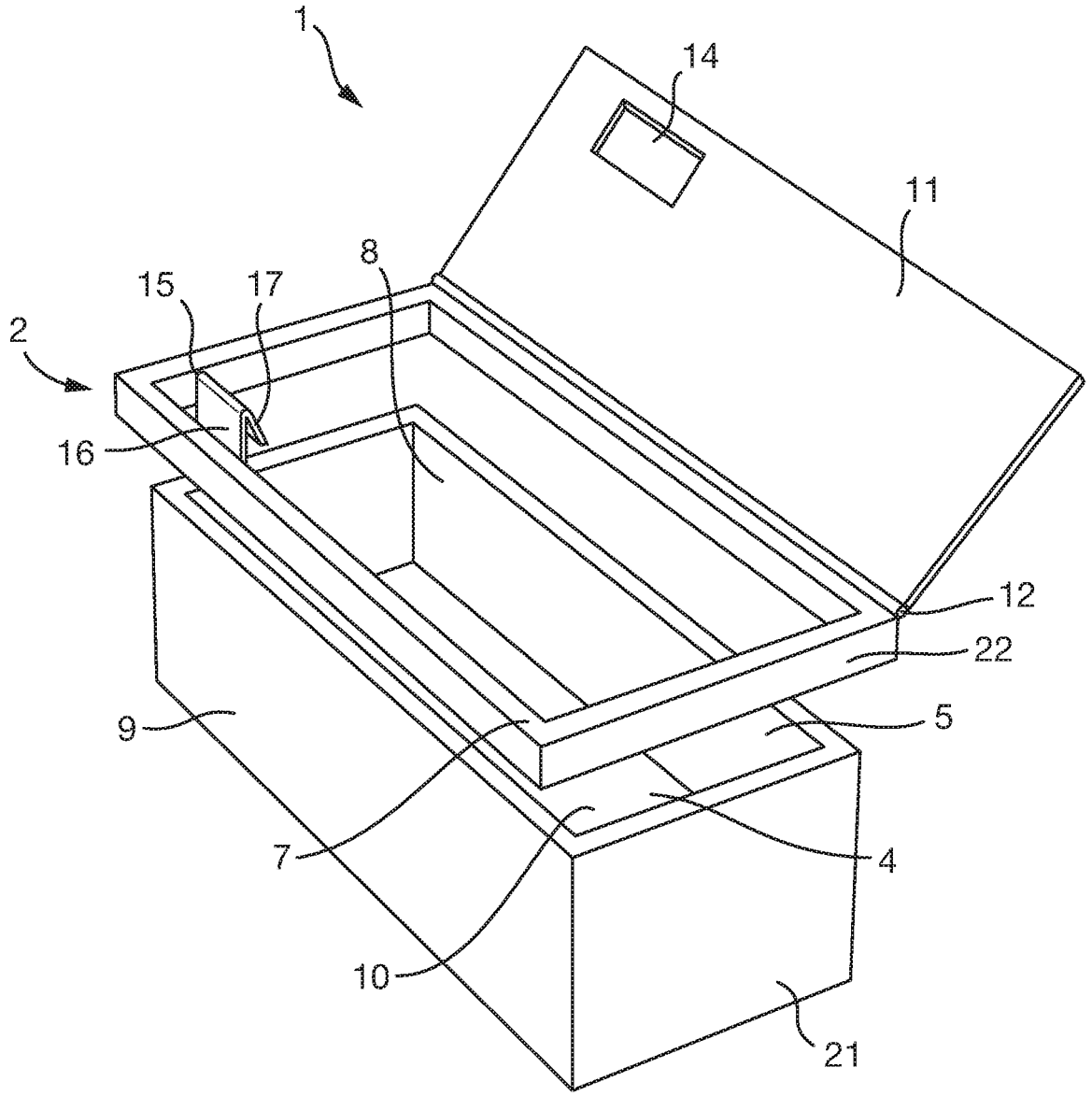
FIG. 8 discloses an exploded view of the container wherein the at least one wall comprises two sections, a lower section connected to the base and an upper section. The upper edge is positioned on the upper section and the wall component is attached to the upper section.

FIG. 8 discloses an exploded view of the container (2) wherein the at least one wall (6) comprises two sections, a lower section (21) connected to the base (4) and an upper section (22). The upper edge (7) is positioned on the upper section (22) and the wall component (15) is attached to the upper section.

Figure 9:
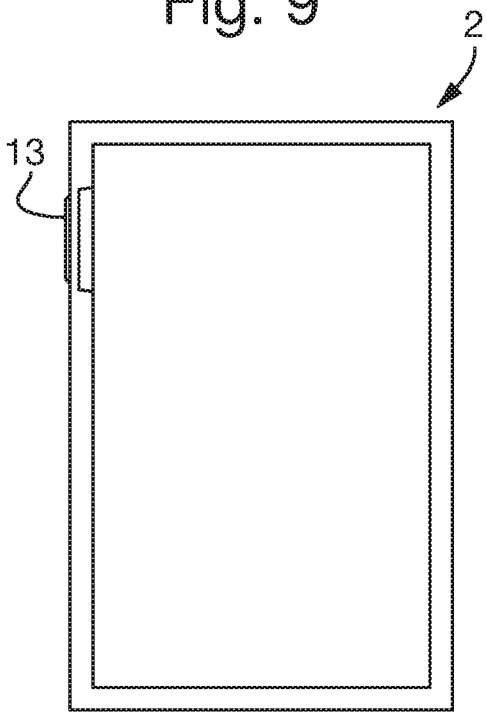
FIG. 9 discloses a top view of the container wherein the container has a footprint defined as the horizontal cross-sectional area through the container and the at least one locking means does not extend beyond the footprint of the container.
Figure 10:
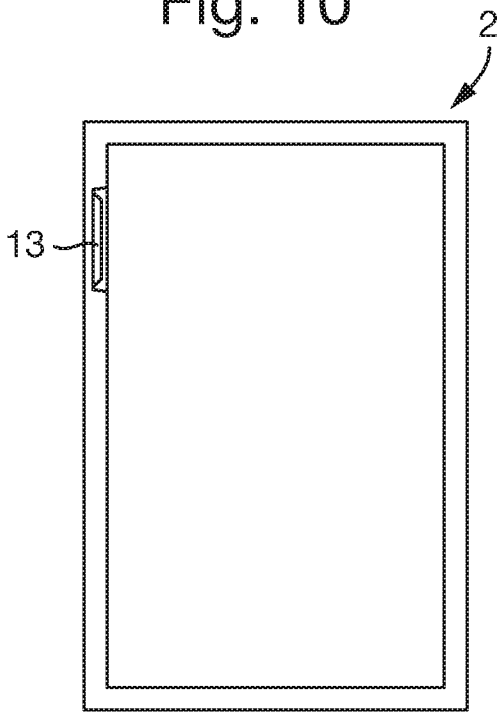
FIG. 10 discloses a top view of the container wherein the container has a footprint defined as the horizontal cross-sectional area through the container and the at least one locking means extends beyond the footprint of the container.

FIG. 9 discloses a top view of the container (2) wherein the container (2) has a footprint defined as the horizontal cross-sectional area through the container (2) and the at least one locking means (13) does not extend beyond the footprint of the container (2). As a comparison, FIG. 10 discloses a top view of the container (2) wherein the container (2) has a footprint defined as the horizontal cross-sectional area through the container (2) and the at least one locking means (13) extends beyond the footprint of the container (2).

Figure 11:
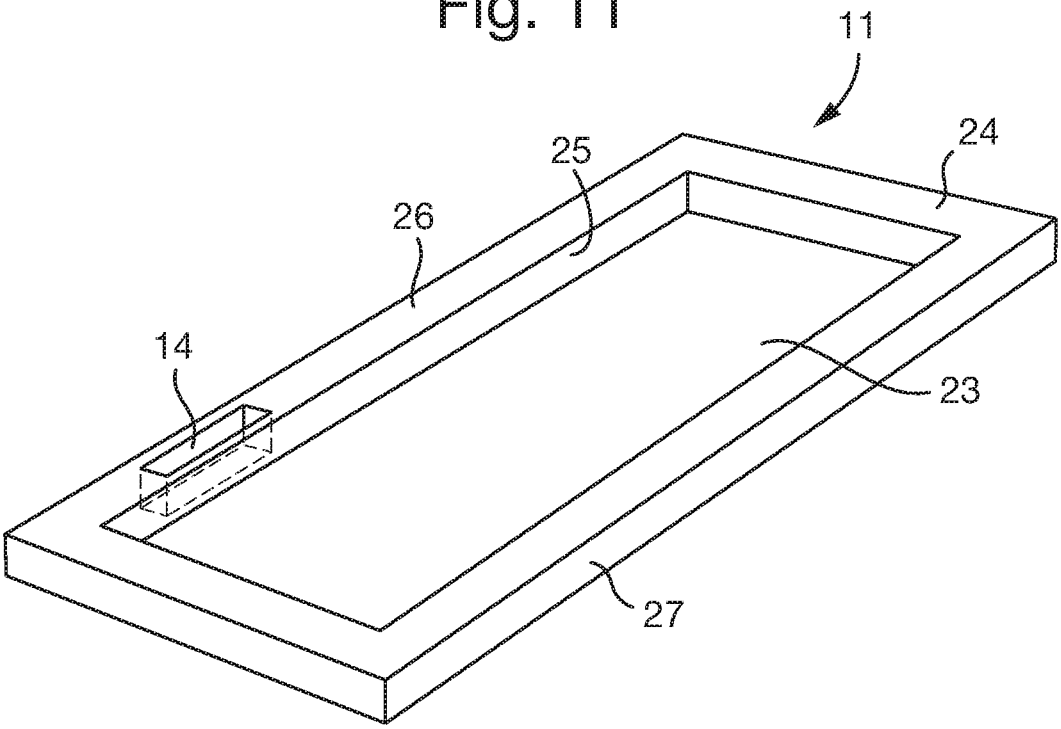
FIG. 11 discloses the lid comprising a recess surrounded by an outer ridge, and wherein the lid component is comprised within the outer ridge.

FIG. 11 discloses the lid (11) comprising a recess (23) surrounded by an outer ridge (24), and wherein the lid component (14) is comprised within the outer ridge (24). The outer ridge (24) comprises an inner side (25), an outer side (27) and a top (26) and the lid component (14) is comprised within the inner side (25) and the top (26). The lid component (14) is a hole through the lid.

Figure 12:
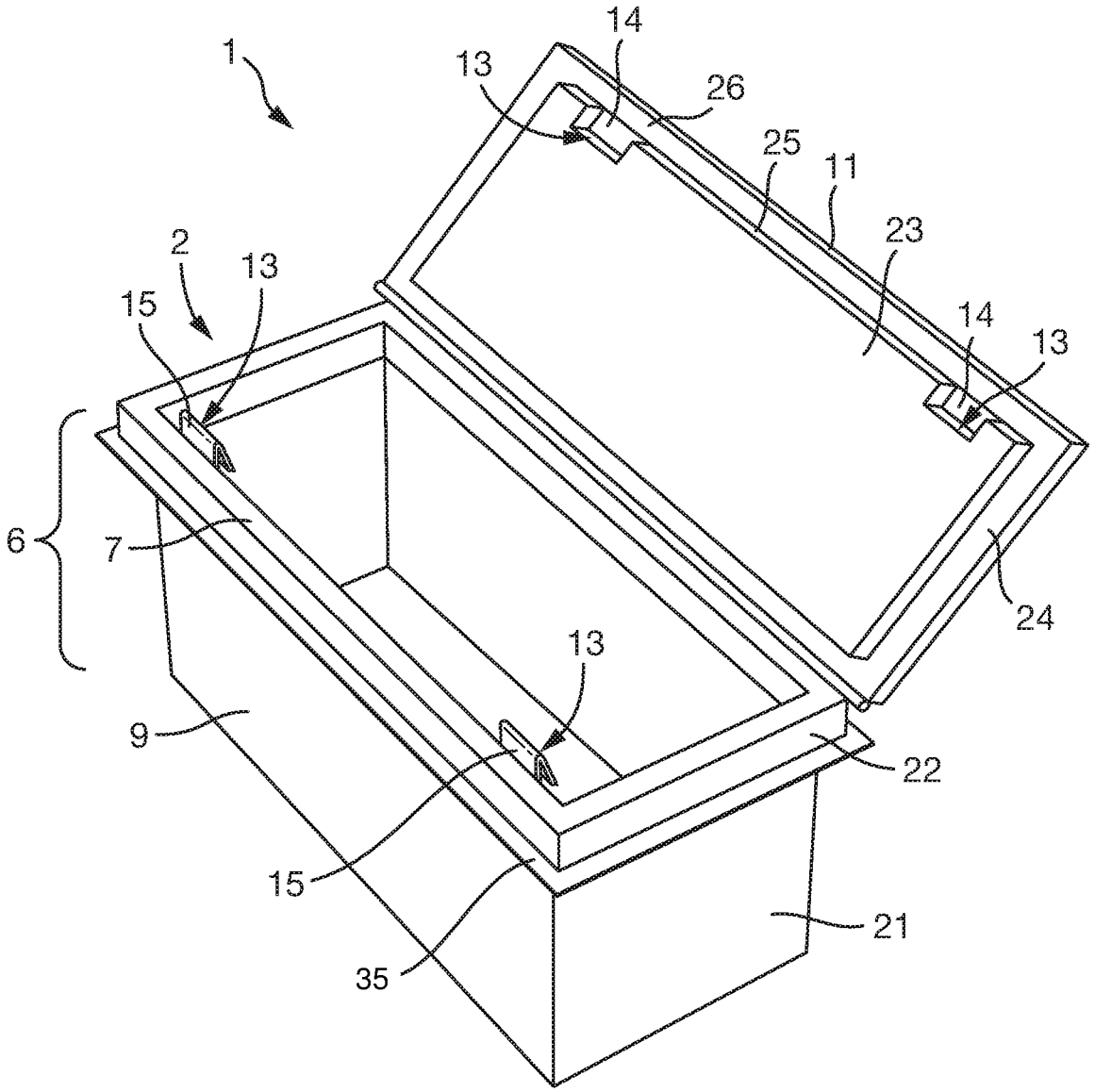
FIG. 12 discloses the consumer product wherein the at least one wall of the container comprises two sections, the upper section and the lower section. The container comprises a lip.

FIG. 12 discloses the consumer product (1) wherein the at least one wall (6) of the container (2) comprises two sections, the upper section (22) and the lower section (21). The two sections are joined together preferably via combination of mechanical connection (hooks) and adhesive. The container (2) also comprises two locking means (13) spaced apart by a distance of from 50 mm to 150 mm The wall component (15) is positioned so that it does not extend higher than the upper edge (7) of the at least one wall (6). The lid (11) comprises a recess (23) surrounded by an outer ridge (24), and wherein the lid component (14) is comprised within the outer ridge (24). The outer ridge (24) comprises an inner side (25), an outer side (27) and a top (26) and the lid component (14) is comprised within the inner side (25) and the top (26). The lid component (14) is a hole through the lid.

FIG. 12 also discloses a container (2) comprising a lip (25). The lid (11) has a footprint defined as the horizontal cross-sectional area of the lid (11) when in a closed position and the container (2) has a footprint defined as the horizontal cross-sectional area through the container (2) and the footprint of the lid (11) is greater than the footprint of the container (2) and a lip (35) extends from the outer surface (9) of the at least one wall (6) such that the footprint of the lip (25) is the same as, or greater than the footprint of the lid (11). Those skilled in the art will understand what is meant by 'footprint of the lid and container'.

Figure 13:
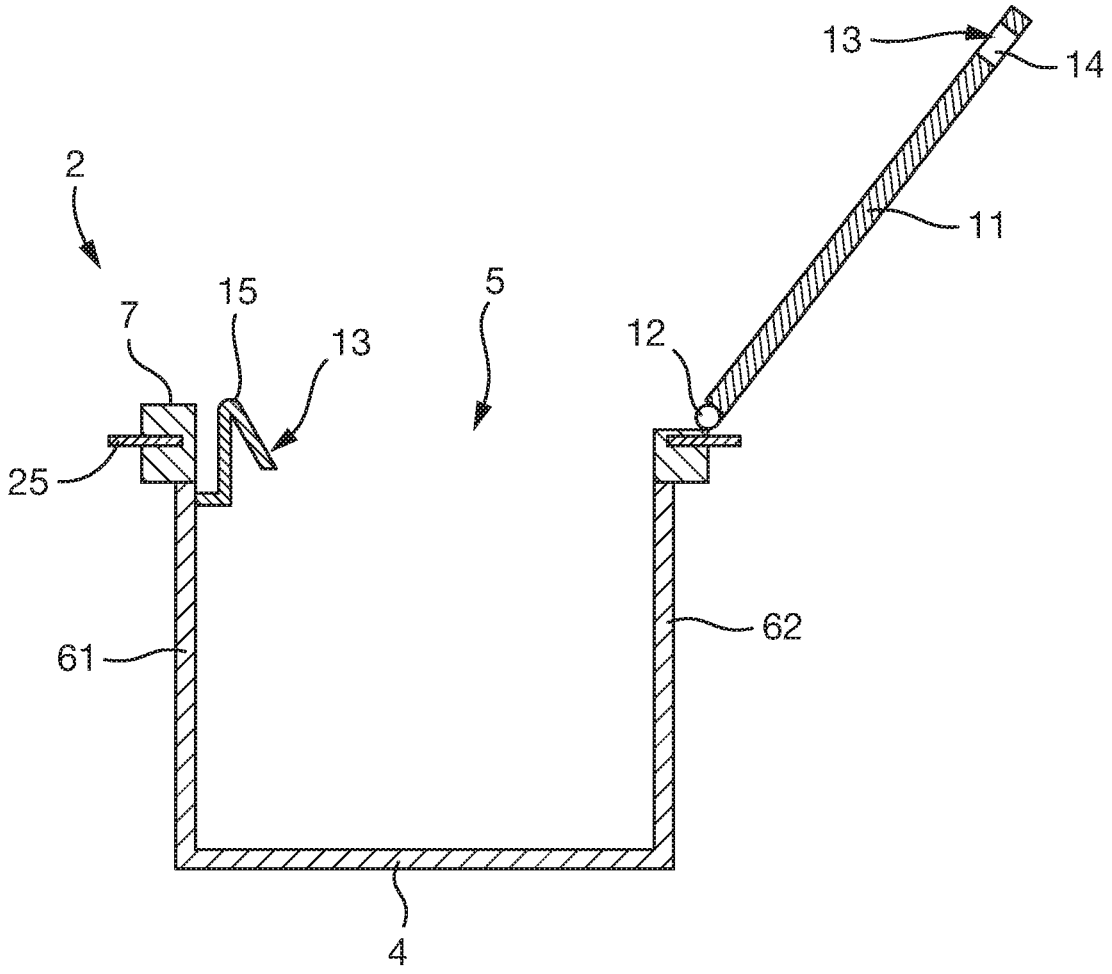
FIG. 13 discloses a cross-sectional view of the container comprising a first wall and a second wall, wherein the hinge is connected to the second wall, and wherein the first wall is positioned opposite the second wall, and wherein the first wall comprises the at least one locking means, preferably at least two locking means.

FIG. 13 discloses a cross-sectional view of the container (2) comprising a first wall (61) and a second wall (62), wherein the hinge (12) is connected to the second wall (62), and wherein the first wall (61) is positioned opposite the second wall (62), and wherein the first wall (61) comprises at least one wall component (15), preferably at least two wall components (15).

Figure 14:
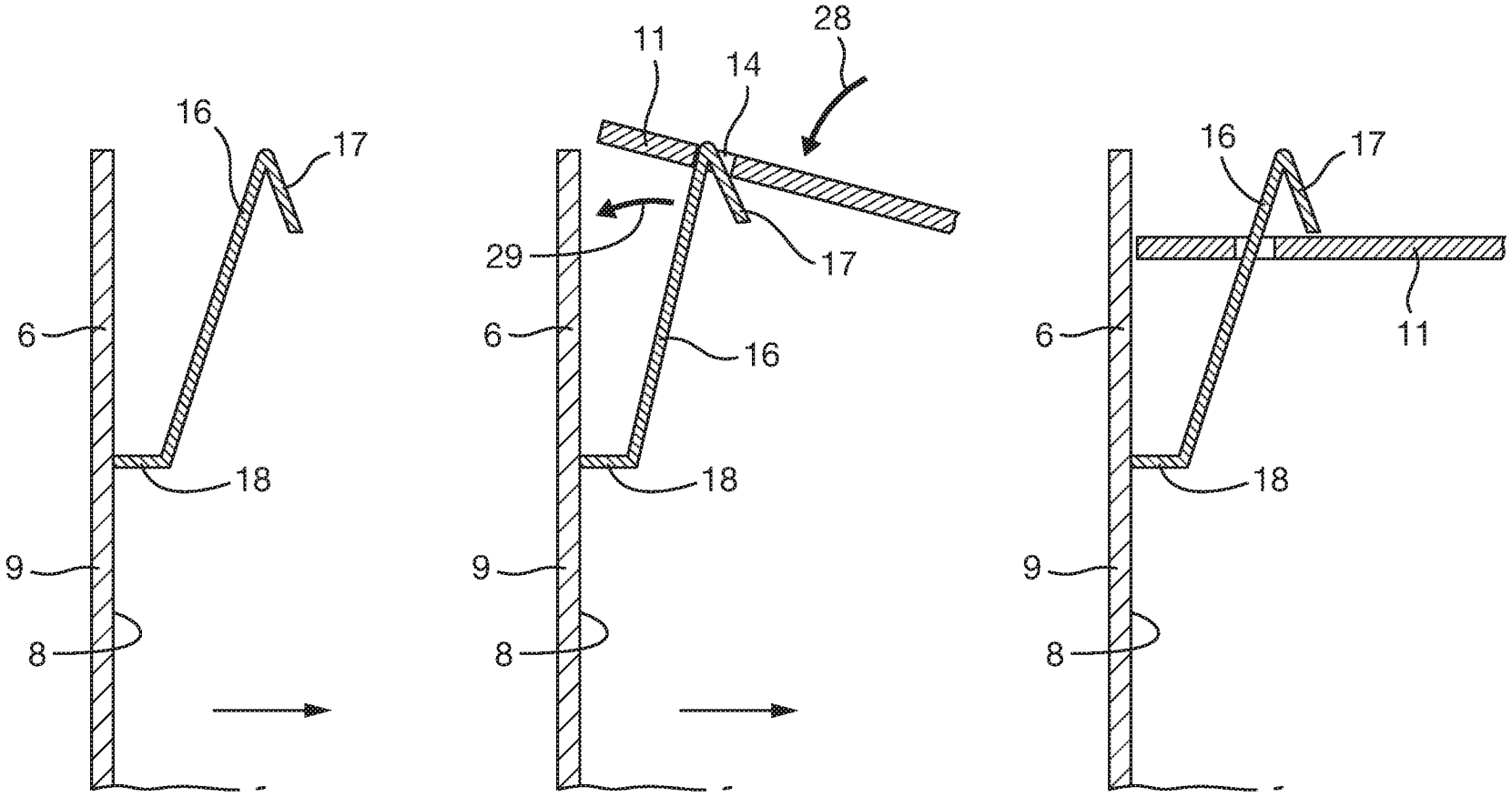
FIG. 14 is a schematic showing movement of the wall component during engagement of the lid component with the wall component.

FIG. 14 is a schematic showing movement of the wall component (15) during engagement of the lid component (14) with the wall component (15). Upon engagement of the wall component (15) with the lid component (14), the support member (16) and hook member (17) are arranged such that the hook member (17) resists rotational movement, whilst still allowing the wall component (15) as a whole to move in response to the force exerted by the engagement of the wall component (14) with the lid component (15). As the lid (11) is moved down (28) towards the wall component (15), the wall component is displaced (29) by the force of the lid (11) on the wall component (15). However, the hook member (17) is not displaced. Upon engagement of the lid component (14) with the wall component (15), the wall component (15) moves back to its original position.

Figure 15:
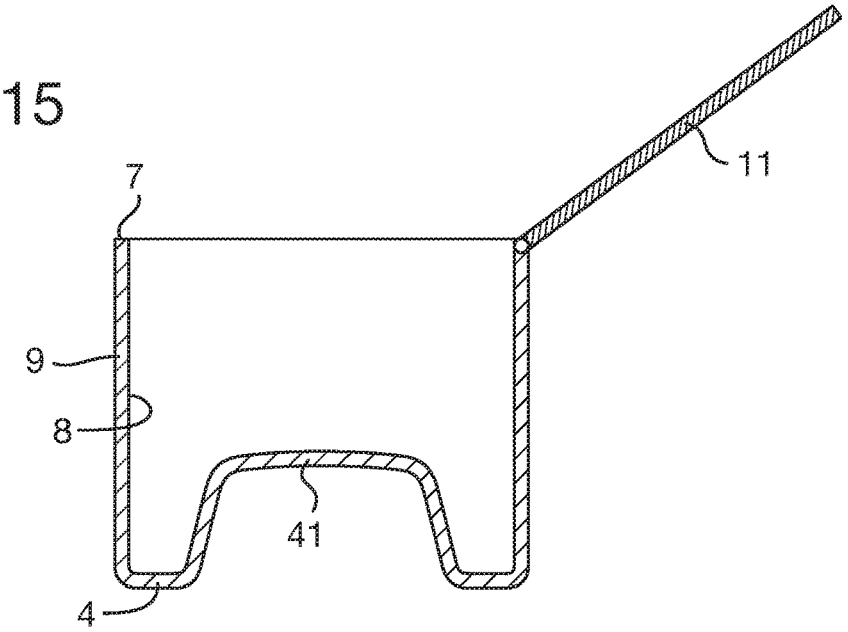
FIG. 15 is a cross-sectional view of the container showing the base with a raised area.

FIG. 15 is a cross-sectional view of the container (2) showing the base (4) with a raised area (41). The areas either side of the raised area (41) act as a reservoir to hold detergent composition which has unintentionally leaked from one or more water-soluble unit dose articles (3).

Figure 16:
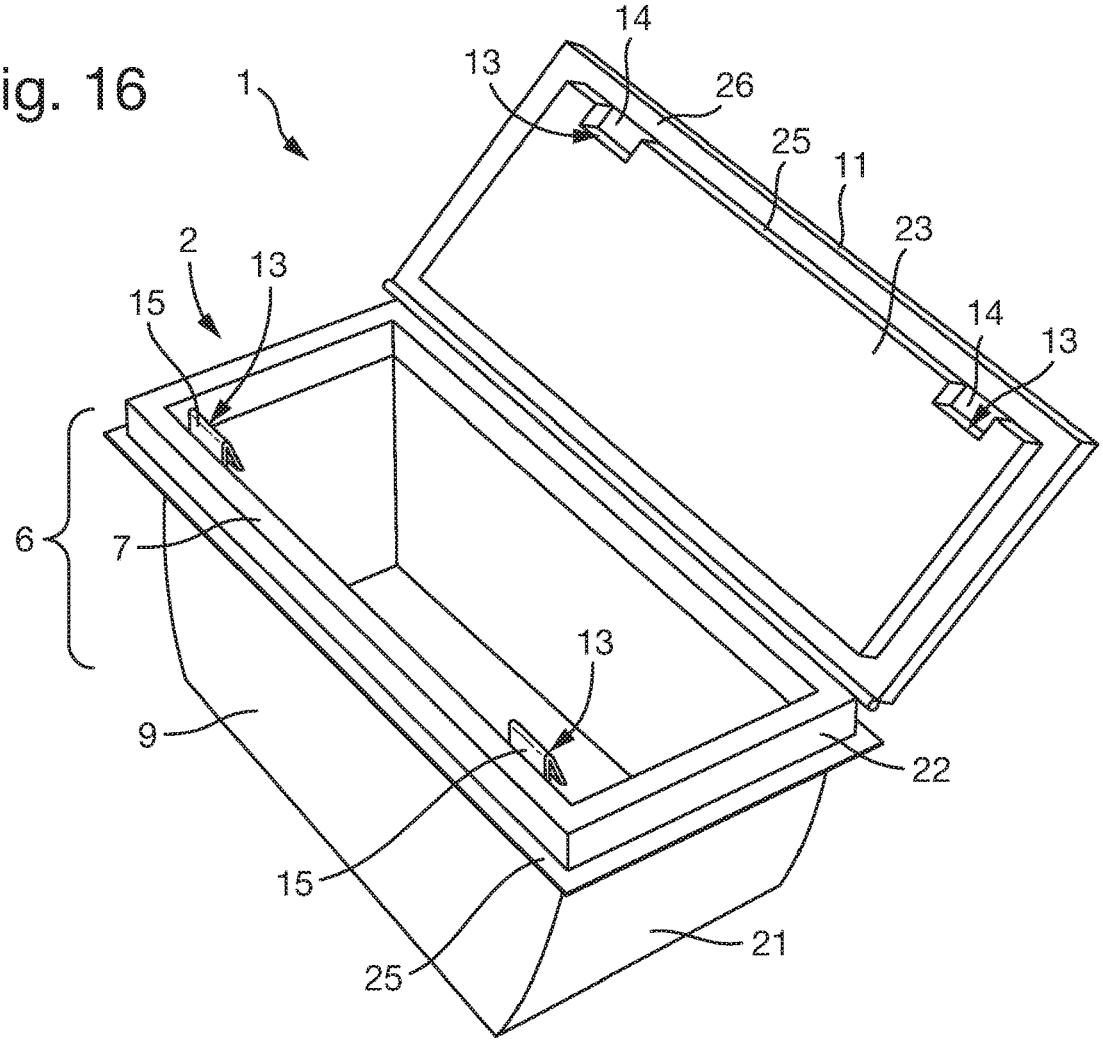
FIG. 16 is the same as FIG. 12 however wherein the at least one side is curved.

FIG. 16 is the same as FIG. 12 however wherein the at least one side (6) is curved.

Figure 17:
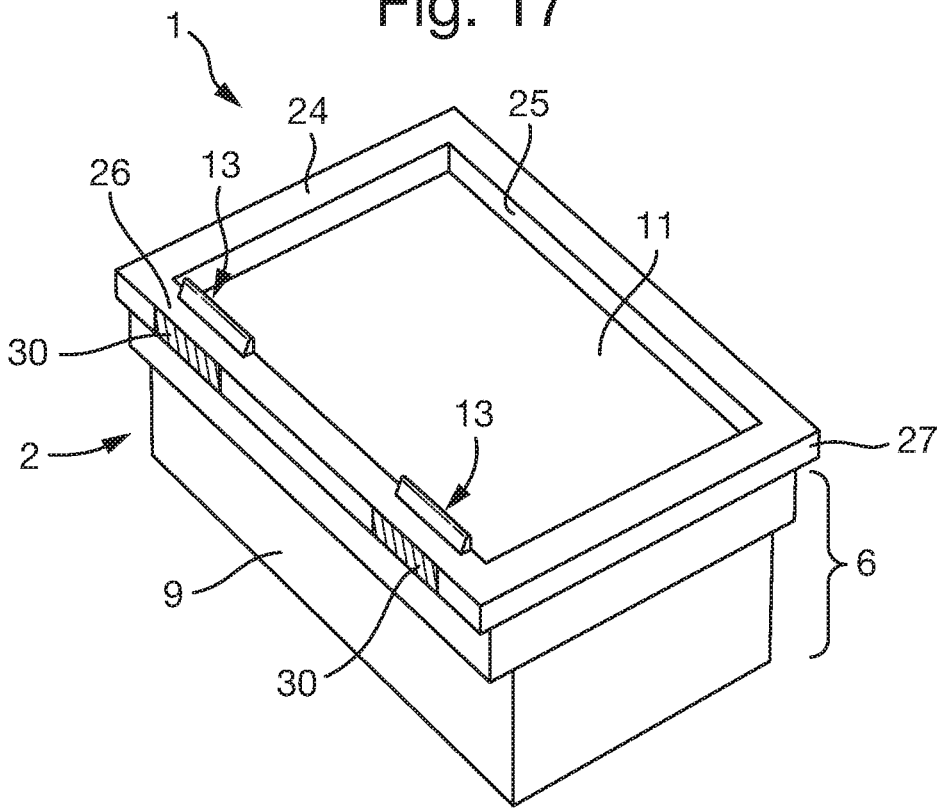
FIG. 17 discloses the container wherein the lid is closed and wherein counterforce areas can be seen on the lid FIG. 18 discloses a wall component wherein the hook member has a first axis and a second axis.

FIG. 17 discloses the container (2) wherein the lid (11) is closed and wherein counterforce areas (30) can be seen on the lid (11).

Figure 18:
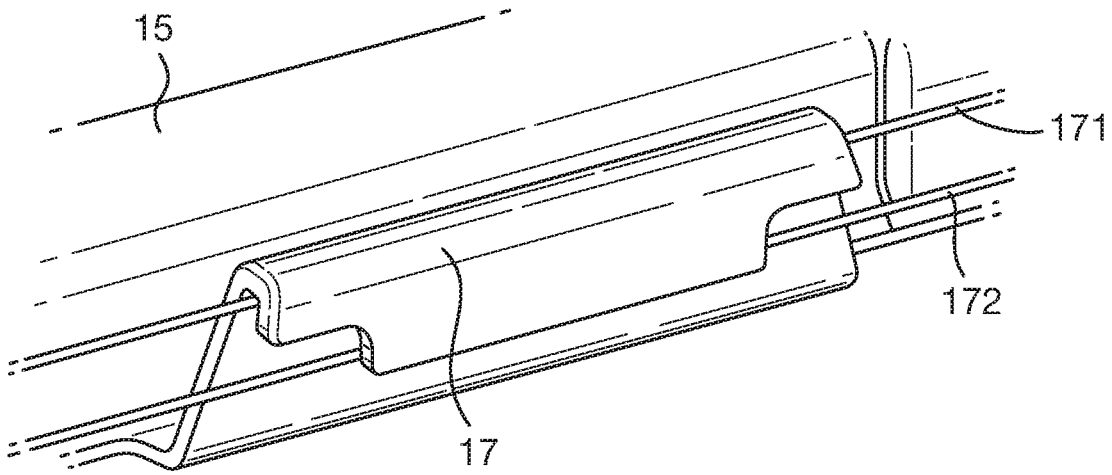

FIG. 18 discloses a wall component (15) wherein the hook member (17) has a first axis (171) and a second axis (172).

Figure 19:
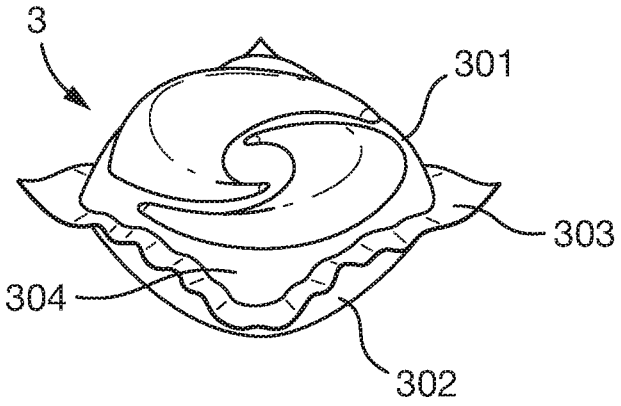
FIG. 19 discloses a water-soluble unit dose article according to the present invention.

FIG. 19 discloses a water-soluble unit dose article according to the present invention. The water-soluble unit dose article (3) comprises a first water-soluble film (301) and a second water-soluble film (302) which are sealed together at a seal region (303). A detergent composition, preferably a laundry detergent composition (304) is comprised within the water-soluble soluble unit dose article (3).

Figure 20:
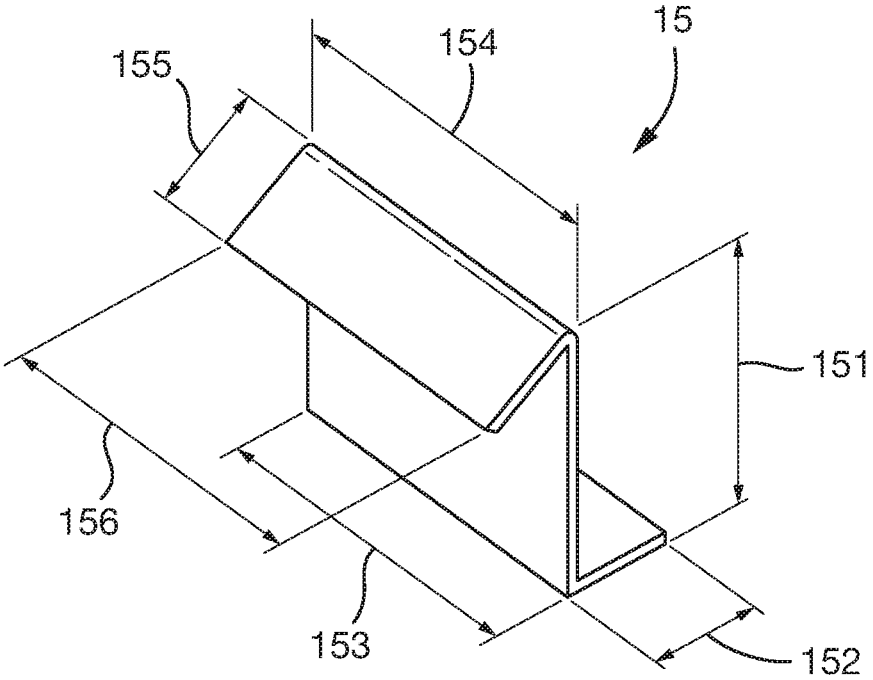
FIG. 20 discloses a wall component according to the present invention.

FIG. 20 discloses a wall component (15) according to the present invention. Dimension 151 is between 5 mm and 15 mm, preferably between 7 mm and 11 mm. Dimension 152 is between 1 mm and 3 mm, preferably between 1.5 mm and 2.5 mm. Dimension 153 is between 20 mm and 40 mm, preferably between 25 mm and 35 mm. Dimension 154 is between 15 mm and 30 mm, preferably between 20 mm and 27 mm. Dimension 155 is between 2 mm and 6 mm, preferably between 3 mm and 5 mm. Dimension 156 is between 10 mm and 20 mm, preferably between 14 mm and 18 mm.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer product (1) comprising a container (2) and at least one water-soluble unit dose article (3) contained therein;

wherein said container (2) comprises:

a base (4), an opening (5) positioned opposite to the base (4); and at least one wall (6) extending vertically from said base (4) to said opening (5), wherein said at least one wall (6) terminates in an upper edge (7) of said at least one wall (6), and wherein said wall (6) comprises an inner surface (8) and an outer surface (9); and wherein said base (4) and the at least one wall (6) define an internal compartment (10) wherein the internal compartment (10) is accessible from the opening (5);

a lid (11) able to move from an open to closed position via at least one hinge (12) and wherein when in the closed position covers the opening (5);

wherein the container (2) comprises at least one locking means (13), wherein the locking means comprises a lid component (14) and a wall component (15), wherein the wall component (15) comprises a support member (16) extending from the upper edge (7) of the at least one wall (6) or the inner surface (8) of the at least one wall (6), and a hook member (17); and wherein, when the lid (11) is in a closed position, the hook member (17) engages the lid component (14) such that only application of force to the hook member (17) will disengage the wall component (15) from the lid component (14); and wherein the hook member (17) extends from the support member (16) towards the interior of the container (10)

characterized in that to disengage the wall component (15) from the lid component (14) requires application of force to the hook member (17) wherein the application of force is in the direction towards the inner surface (8).

2. The consumer product (1) according to claim 1 wherein the outer surface (9) of the at least one wall (6) is devoid of any locking means.

3. The consumer product (1) according to claim 1 wherein the at least one wall (6) comprises at least two sections (21, 22) wherein the sections are joined together.

4. The consumer product (1) according to claim 3 wherein the sections are joined together via adhesive, mechanical connection, or a combination thereof.

5. (Orignal) The consumer product (1) according to claim 1 comprising at least two locking means (13).

6. The consumer product (1) according to claim 5 wherein the at least two locking means (13) are spaced apart by a distance of from about 50 mm to about 180 mm.

7. The consumer product (1) according to claim 5 wherein the two locking means (13) are positioned on the same wall, and wherein the hinge (12) is present on a second wall (62)

and the at least two locking means are present on a first wall (61) and wherein the first wall (61) is opposite the second wall (62).

8. The consumer product (1) according to claim 1 wherein the support member (16) extends from the inner surface (8) of the at least one wall (6).

9. The consumer product (1) according to claim 8 wherein the wall component (15) is positioned such that it does not extend higher than the upper edge (7) of the at least one wall (6).

10. The consumer product (1) according to claim 1 wherein the lid (11) comprises a recess (23) surrounded by an outer ridge (24), and wherein the lid component (14) is comprised within the outer ridge (24), and wherein the outer ridge (24) comprises an inner side (25), an outer side (27) and a top (26) and wherein the lid component (14) is comprised within the inner side (25), the top (26), or a mixture thereof.

11. The consumer product (1) according to claim 1 wherein upon engagement of the wall component (15) with the lid component (14), the support member (16) and hook member (17) are arranged such that the hook member (17) resists movement, whilst still allowing the wall component (15) as a whole to move (29) in response to the force exerted (28) by the engagement of the wall component (15) with the lid component (14).

12. The consumer product (1) according to claim 1 wherein the container (2) is made of natural materials, synthetic materials, or a mixture thereof.

13. The consumer product (1) according to claim 1 wherein the container (2) is opaque, translucent, or a mixture thereof.

14. The consumer product (1) according to claim 1 wherein the water-soluble unit dose article (3) comprises a water-soluble film (301, 302) and a detergent composition (304).

15. The consumer product (1) according to claim 1, wherein unlocking the wall component (15) from the lid component (14) does not deform the lid (11) or the at least one wall (6).

16. The consumer product (1) according to claim 1, wherein the support member (16) and the hook member (17) are arranged such that the wall component (15) is in the shape of an inverted U.

17. The consumer product (1) according to claim 16 wherein the U shape is attached to the inner wall (8) or the upper edge (7) via a horizontal connecting member (18) extending from the inner wall (8) or the upper edge (7) to the support member (16).

* * * * *